United States Patent [19]

Schwarzmann

[11] Patent Number: 4,498,085

[45] Date of Patent: Feb. 5, 1985

[54] FOLDED DIPOLE RADIATING ELEMENT

[75] Inventor: Alfred Schwarzmann, Mount Laurel, N.J.

[73] Assignee: RCA Corporation, New York, N.Y.

[21] Appl. No.: 428,585

[22] Filed: Sep. 30, 1982

[51] Int. Cl.[3] ..... H01Q 9/28

[52] U.S. Cl. ..... 343/795; 343/803; 343/821

[58] Field of Search ..... 343/793-795, 343/803, 807, 767, 700 MS, 371, 804, 846-848, 343, 820, 821

[56] References Cited

U.S. PATENT DOCUMENTS

| | | | |
|---|---|---|---|
| 2,507,528 | 5/1950 | Kandoian | 343/767 |
| 2,978,703 | 4/1961 | Kuecken | 343/803 |
| 3,488,657 | 1/1970 | Pressel et al. | 343/708 |
| 3,587,110 | 6/1971 | Woodward | 343/813 |
| 3,623,112 | 11/1971 | Rupp | 343/727 |
| 3,678,418 | 7/1972 | Woodward | 333/26 |
| 3,805,269 | 4/1974 | Fujimoto et al. | 343/794 |
| 4,001,834 | 1/1977 | Smith | 343/754 |
| 4,035,807 | 7/1977 | Tang et al. | 343/742 |
| 4,042,935 | 8/1977 | Ajioka et al. | 343/795 |
| 4,084,162 | 4/1978 | Dubost et al. | 343/700 MS |
| 4,238,745 | 12/1980 | Schwarzmann | 333/164 |
| 4,284,868 | 8/1981 | Simpson | 343/700 MS |

FOREIGN PATENT DOCUMENTS

| | | | |
|---|---|---|---|
| 137643 | 12/1947 | Australia | 343/803 |
| 1003559 | 1/1977 | Canada | 343/795 |
| 861114 | 11/1952 | Fed. Rep. of Germany | 343/793 |
| 2020192 | 11/1971 | Fed. Rep. of Germany | 343/700 MS |
| 2325704 | 12/1974 | Fed. Rep. of Germany . | |

*Primary Examiner*—Eli Lieberman
*Assistant Examiner*—Michael C. Wimer
*Attorney, Agent, or Firm*—Joseph S. Tripoli; Robert L. Troike; Robert Ochis

[57] ABSTRACT

A one-piece array antenna folded dipole radiating element is formed from a wide, thin conductor. This element is suitable for attachment to a microstrip or other feed circuit. The radiation element includes a folded dipole portion, a balanced transmission line portion and may include a balun portion. These various portions are formed by providing an appropriately shaped slot or aperture in the thin conductor.

12 Claims, 5 Drawing Figures

FOLDED DIPOLE RADIATING ELEMENT

The present invention relates to phased array antennas and more particularly to radiating elements useful in such arrays.

A related application entitled "DIPOLE RADIATING ELEMENT" Ser. No. 428,586, filed Sept. 30, 1982, in the name of David Bowman and assigned to the present assignee is concurrently filed with this application.

Phased array antennas are known in which each element has an individual phase shifter associated with it. Waveguide horn elements, which often employ gyromagnetic phase shifters, and radiating elements which are not of the horn type, which often employ solid state (e.g. diode) phase shifters, are two types of elements which may be used in such arrays.

The solid state phase shifters and their associated radiating elements are usually selected for array applications where low weight and/or low cost are primary selection criteria. Continuing development of array antennas has led to increasingly stringent overall performance specifications which require several thousand or more individual radiating elements in the antenna. These requirements have resulted in a corresponding increase in the complexity of those array elements and a tightening of fabrication tolerances for those elements. These combine to increase the cost of each element. For an array this cost increase is multiplied by the number of elements in the array.

A radiating element suitable for use in a solid state type phased array antenna is needed which has both the radiation characteristics required to meet high performance requirements and a structure which makes inexpensive fabrication possible.

The present invention provides an array element structure combining high performance with ease of manufacture and relatively low cost. A radiating element in accordance with one embodiment of this invention comprises a one piece, wide, thin electrical conductor having first, second and third sections. The third section is wider than the first section. The second section connects the first section to the third section and spaces the first and third sections apart. The third section comprises a folded dipole. A first elongated slot extends laterally within the third section and defines the inner periphery of the folded dipole. A second elongated slot in the thin conductor extends from the first section into the third section, connects to the first slot and separates the second section into first and second spaced apart transmission line members. The portion of the second slot which extends into the third section separates the portion of that section which is adjacent the second section into first and second spaced apart feed points of the folded dipole. The first and second feed points are connected directly to the first and second transmission line members, respectively. The first section of the element of the conductor is adapted for bonding to a feed circuit. When bonded to a feed circuit, the first section electrically couples the radiating element to that circuit and structurally supports the radiating element. Each of the sections is preferably substantially planar and the second and third sections are preferably disposed in a common plane. In a preferred embodiment the first and second slots together comprise a T-shaped aperture in the conductor.

IN THE DRAWINGS

Figure 1:
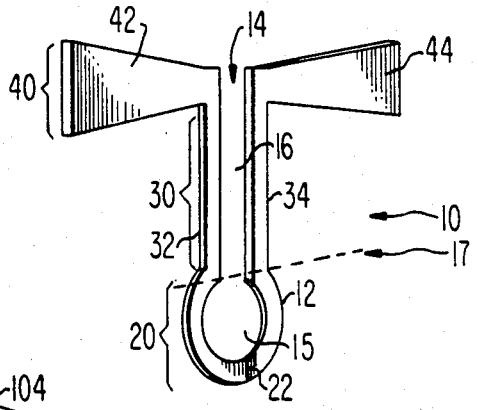
FIG. 1 is a plan view of a radiating element on which the present invention improves.

A radiating element 10 is illustrated in FIG. 1. The element 10 is formed from a wide, thin, electrical conductor 12 which may preferably be sheet metal such as 0.02 inch (0.05 centimeter) thick brass or copper. This one piece element may be formed by stamping or milling. Element 10 has first, second and third sections, 20, 30 and 40, respectively. A slot 14 through the thin dimension of the conductor extends from within the first section 20 through the second section 30 and the third section 40 to give the element 10 a generally U-shaped configuration. Slot 14 has a wide or foot portion 15 at its end which is within the first section (20) of element 10. The foot portion 15 of the slot has a generally circular periphery. The remainder of slot 14 which may be referred to as a leg portion 16 is of substantially uniform width.

The first section 20 of element 10 comprises a balun member segment 22 formed from conductor 12. Balun member 22 is adapted for bonding to a feed circuit where it becomes a portion of a transmission line. That transmission line is preferably an odd integer multiple of one-half wavelength (preferably $\frac{1}{2}$ wavelength) long at a frequency near the middle of the designed operating frequency range of element 10.

The second section 30 of element 10 comprises a balanced transmission line and connects the first section 20 to the third section 40. The leg portion 16 of slot 14 separates the section 30 into two spaced apart transmission line members 32 and 34 which together with the dielectric characteristics (air dielectric) of slot portion 16 form the balanced transmission line. The balun member 22 connects the first transmission line member 32 to the second transmission line member 34. The portion of conductor 12 which comprises transmission line members 32 and 34 and balun member 22 is preferably of substantially constant width. The width of the leg portion 16 of slot 14 is of the same order as the width of transmission line members 32 and 34.

The third section 40 of element 10 comprises a dipole radiator. The slot 14 separates the dipole section 40 into two separate spaced apart dipole members 42 and 44. The transmission line members 32 and 34 connect to dipole members 42 and 44, respectively at dipole feed points where sections 30 and 40 meet. These feed points are also spaced apart by slot 14.

Figure 2:
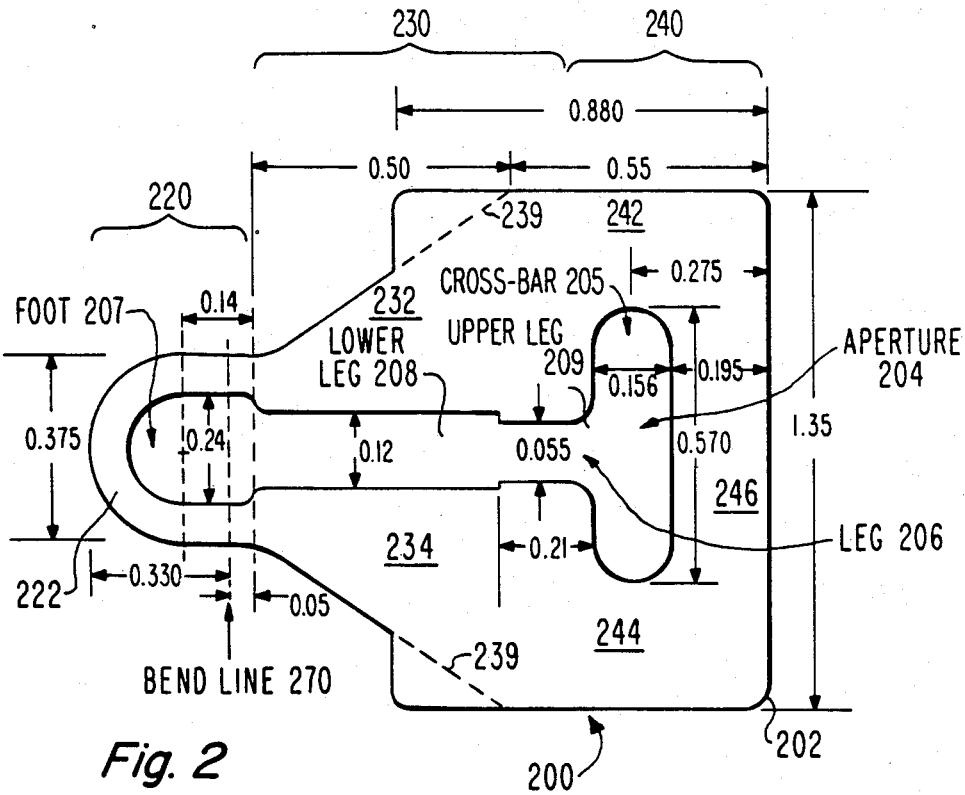
FIG. 2 is a plan view of a radiating element in accordance with the invention.

FIG. 2 illustrates, in plan view, an element 200 in accordance with the present invention. Element 200 is a modified version of the element 10. This element is similar to element 10 in that it is a one piece radiating element formed from a single wide thin conductor (202). This element has first, second and third sections 220, 230 and 240, respectively. Section 240 is substantially wider than section 220. Element 200 differs from element 10 in that rather than having an open-ended slot 14 separating its second section into two spaced apart transmission line members (232 and 234) it has a single closed ended slot or aperture 204 therein and electrically is a folded dipole radiator. The aperture 204 is generally T-shaped with a cross bar portion 205 connected to an end of a leg portion 206. The cross bar portion 205 is within the third section 240 and defines the inner periphery of the folded dipole. The leg portion 206 of the aperture 204 has a non-uniform width. The widest portion of the leg is a foot portion 207 within the first section 220 of the element. Foot 207 is substantially circular and defines the inner periphery of a balun member 222 and is continuous with a lower leg portion 208 of aperture 204. The outer periphery of balun member 222 is also substantially circular. Thus, balun member 222 is substantially annular. Lower leg portion 208 of aperture 204 is narrower than the foot 207. As with element 10, the balun member when bonded to a feed circuit forms part of a transmission line which is preferably ½ wavelength long (or an odd integer multiple thereof) at a desired frequency. The lower leg portion 208 is continuous with an upper leg portion 209 which connects to the cross bar portion 205. The upper leg portion 209 is narrower than the lower leg portion 208. The upper and lower leg portions 209 and 208 of aperture 204 together space apart the two transmission line members 232 and 234. The widths of the lower and upper leg portions 208 and 209, are selected to control electrical characteristics of the balanced transmission line which couples the first section 220 of the element to the folded dipole portion 240 of the element.

The portion 246 of the third section of element 200 mechanically stiffens the element by tying the two sides 242 and 244 of the dipole portion together. This helps to prevent the two sides of the second and third sections of the element from being accidentally bent into a non-planar configuration. A bent-out-of-plane condition can occur more easily with element 10. It is portion 246 which makes the element 200 electrically a folded dipole. Cross-bar portion 205 of aperture 204 controls the minimum size of the current loop of the folded dipole because it defines the size and shape of the dipole's inner periphery.

The second section 230 of element 200 has a generally trapezoidal outline and tapers from a relatively narrow base at the first section 220 to a relatively wide base at the third section 240. Thus, each of the balanced transmission line members tapers substantially from a narrow end where it connects to the first section (or balun) to a relatively wide end where it connects to the dipole. This taper aids in optimizing the overall radiation characteristics of the element 200 in the frequency range of operation. Dashed lines 239 are not physically present on element 200. They are to indicate the point where an extension of the tapering outer edge of section 230 reaches the outer edge of the element.

Each of the sections of the element 200 is preferably planar and the second and third sections are preferably disposed in a common plane. It is preferred to bend the element at the line 270 to place the first section 220 in a plane which is at a 90° angle to the common plane of the second and third sections.

Figure 3:
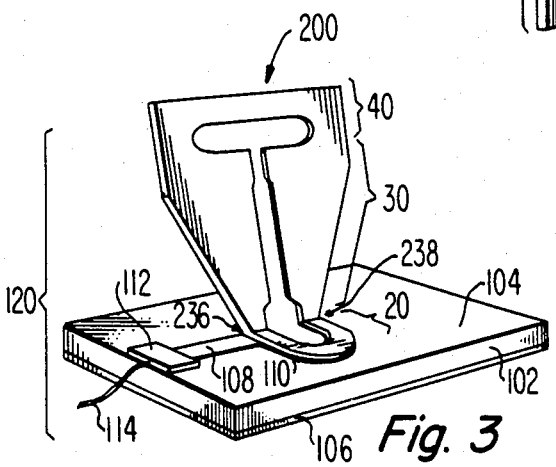
FIG. 3 is a perspective view of a module comprising the element of FIG. 2 mounted on a microstrip feed circuit.

In FIG. 3 an element 200 in this bent configuration is illustrated bonded to a microstrip feed circuit 100 to form a module 120. The feed circuit 100 includes an alumina substrate 102, having an upper major surface 104 (in FIG. 3). A ground plane 106 covers the lower major surface. An unbalanced transmission line conductor 108, a balun member conductor 110 and phase control circuitry 112 are disposed on the upper surface 104. Conductors 108 and 110 form a transmission line with the dielectric substrate 102 and the ground plane 106. Balun member 110 preferably has the same outline as the balun segment 222 of element 200 in order that they may be soldered together to form a unitary structure. It is the transmission line formed by this unitary structure with dielectric 102 and conductor 106 which is preferably ½ wavelength long. Conductor segment 222 is preferably soldered along its entire length to the conductor 110. The unbalanced transmission line formed by conductor 108 and ground plane 106 couples the phase shifter 112 to the balun and thus to element 200.

An external signal may be provided to phase shifter 112 by a transmission line 114. Alternatively module 120 can operate in a reflectarray mode in which a signal is received by element 200, transmitted to phase shifter 112 and reflected back to element 200 and radiated. The element 200 is inexpensive to fabricate and is easily and reliably attached to the feed circuit 100 by soldering and provides the superior performance needed in modern phased arrays. The printed circuitry of feed circuit 100 may be inexpensively fabricated using photolithographic techniques. The phase shifter may be in accordance with my U.S. Pat. No. 4,238,745 which is incorporated herein by reference. Thus, individual modules 120 are inexpensive to fabricate. A plurality of modules 120 may be positioned in a two dimensional array on a plane to form a planar phased array.

In a transmission mode of operation the module 120 of FIG. 3 accepts an unbalanced transmit signal from transmission line 114. This unbalanced signal is referenced to a ground potential which is applied to the ground plane 106. This signal may be at a frequency at which balun 110 is one-half wavelength long. The phase shifting circuitry 112 adjusts the phase of the transmit signal in accordance with the setting of its phase shifter control elements which may be diodes. From the phase shifter the signal propagates along the unbalanced transmission line comprised of the conductor 108 and the ground plane 106. This unbalanced signal on reaching the balun conductor 110 traverses the balun. Since the transmission line formed by balun 110, substrate 102 and ground plane 106 is half a wavelength long, the signals at points 236 and 238 are one half cycle out of phase. These two signals comprise a balanced signal which propagates up the balanced transmission line formed by members 232 and 234. Upon reaching the folded dipole the signal is radiated into the surrounding medium.

When the module 120 is used for reception of radiation signals, the module operates in a manner which is reciprocal to its transmission mode of operation. The radiation signal couples to the folded dipole, propagates down the transmission line formed by members 232 and 234 as a balanced signal and is converted to an unbalanced signal by the balun 110. This unbalanced signal propagates along the unbalanced transmission line formed by conductor 108 and ground plane 106 to the phase shifter circuitry 112. Phase shifter circuitry 112 impresses a phase shift on the received signal in accordance with the setting of the phase shifter. From there the signal propagates to a receiver or other utilization device or in a reflectarray is reflected back to element 200 for re-radiation.

Figure 5:
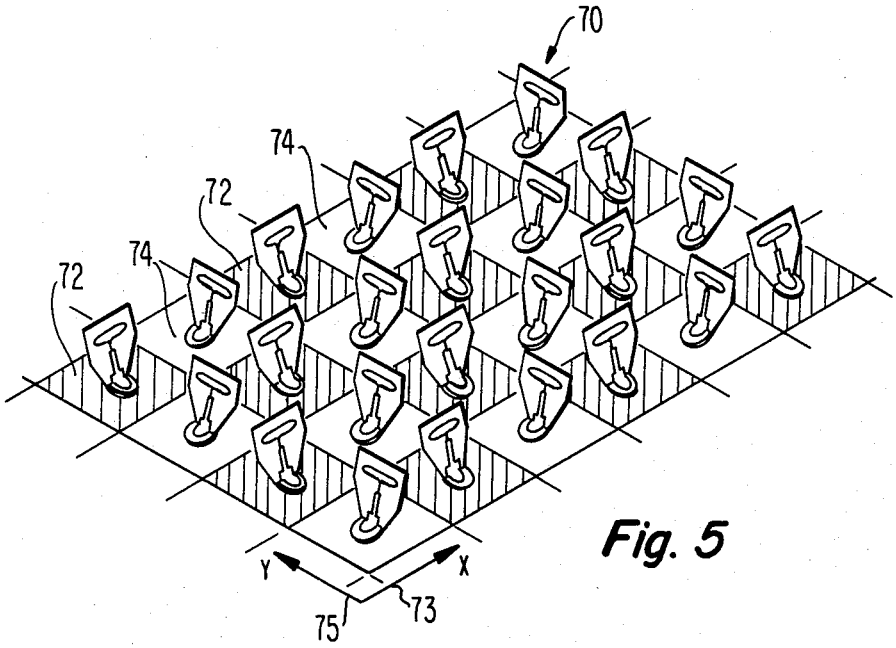
FIG. 5 is a perspective view of a planar array of modules like those in FIG. 3.

The details of the configuration of the radiation element 200 depend on the characteristics desired for the array for which it is designed. The details of element 200 also depend on its intended operating frequency range and the lattice or grid center-to-center spacing of adjacent modules in that array. The element of FIG. 2 can be used in an array antenna having an operating frequency range of 3.1 to 3.5 GHz, in which the modules 120 are positioned in a checkerboard grid configuration with module center-to-center spacings of about 3.5 inch in the x direction, of about 1 inch row-to-row spacing in the Y direction and diagonal spacings of about 2 inches. FIG. 5 would illustrate such an array if only the modules in the shaded squares are included. FIG. 5 will be discussed hereafter.

The array for which element 200 is designed is specified to have sidelobes which are down about 25 dB from the main beam. The preferred dimensions of the radiation element 200 are as indicated in the drawing where dimensions are in inches. At the center frequency (3.3 GHz) the element 200 has a height of about a quarter of a wavelength from the line 270 to the top of the element and has a width at the wide end of about 1.5 times its height.

The general configuration of radiation element 200 as illustrated in FIG. 2 is preferred because of its superior radiation characteristics. However, other general configurations for the radiation element also provide useful results.

Figure 4:
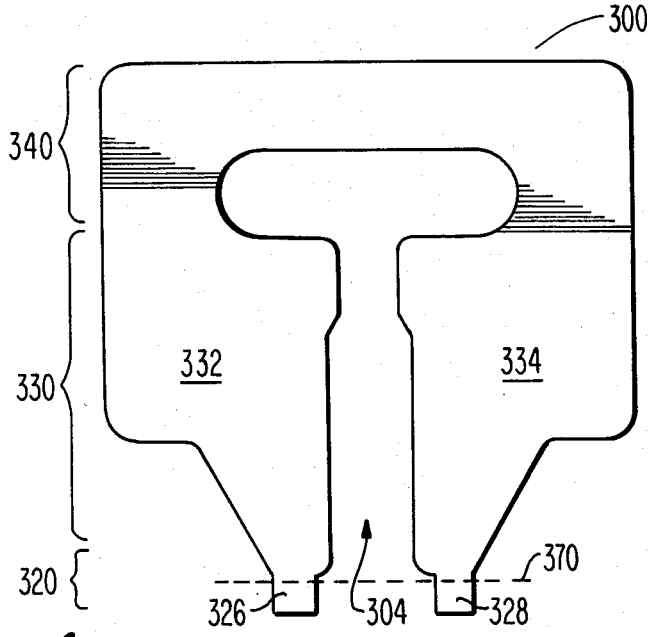
FIG. 4 is a plan view of a modified form of the element of FIG. 2.

An alternative configuration for the folded dipole radiation element is shown generally at 300 in FIG. 4. Portions of element 300 which correspond to portions of element 200 have been given reference numbers in the 300's which have the same final two digits as the corresponding portion of element 200. Element 300 is substantially identical to the element 200 except that rather than having a closed T-shaped aperture 204, element 300 has a T-shaped slot 304 which is open at the foot of the T. Element 300 has two bonding tabs 326 and 328 instead of a semicircular balun member. Thus, in element 300 the first section 320 does not connect the two sides 332 and 334 of the balanced transmission line to each other. The configuration of the second and third sections 330 and 340 are otherwise very similar to the configuration of the corresponding portions of the radiation element 200 in FIG. 2. Bonding of the tabs 326 and 328 to the balun member 110 of the microstrip circuit 100 such as the one shown in FIG. 3, will secure the radiation element 300 to the microstrip circuit 100. Minor modifications may need to be made in the balun member 110 to compensate for the lack of the additional layer of conductive material which the balun member 222 of radiation element 200 would have provided. Further, in the absence of the continuous balun member, the two transmission line members 332 and 334 are easily bent out of their common plane (prior to bonding). Therefore, if a planar configuration is desired, care must be taken to ensure that the second and third sections of element 300 remain planar at the time the tabs 326 and 328 are bonded to the microstrip circuit.

The array 70 illustrated in FIG. 5 is comprised of modules 120 having elements 200 as their radiation members. The radiating elements 200 are arranged in a checkerboard pattern. Modules 72 in the location of shaded squares of the checkerboard have elements 200 having their width dimension aligned parallel to the x-axis 73 of the pattern. The modules 74 in the unshaded squares of the pattern have the width dimension of their elements aligned parallel to the y-axis 75 of the pattern. This element pattern corresponds to two separate arrays each having a triangular grid but which are rotated 90° with respect to each other and interlaced to place the elements of one grid in the gaps in the other grid. Activation of just the modules in the shaded squares produces a first polarization radiation. Activation of just the modules in the unshaded squares produces radiation having a polarization at 90° to the first polarization. Activation of both sets of modules can produce any desired polarization by appropriate relative phase and amplitude control. For reception this array can respond to all radiation polarizations.

What is claimed is:

1. A radiation structure for operation over a range of frequencies comprising:

a one piece radiating element in the form of a wide, thin electrical conductor, said conductor having first, second and third sections, said third section being wider than said first section and said second section connecting said first section to said third section;

said first section adapted for connection to a feed circuit;

said third section having a width of about $\frac{3}{8}$ of a wavelength at a frequency within said range of frequencies and comprising a folded dipole having first and second feed points;

said third section having a first elongated slot to define the inner periphery of said folded dipole;

said conductor having a second elongated slot in communication with and extending from said first slot through said second section to said first section to space apart said first and second feed points of said folded dipole and to separate said second section into first and second spaced apart transmission line members, said first and second transmission line members coupling said first section to said feed points of said folded dipole;

said element being free of ground conductors extending parallel to said second and third sections; and said first slot being less than $\frac{3}{8}$ of a wavelength long at a frequency within said range of frequencies.

2. The radiation structure recited in claim 1 wherein:

each of said sections is planar; and said second and third sections are disposed in a common plane.

3. The radiation structure recited in claim 1 wherein:

said thin electrical conductor has a width perpendicular to the length of said second slot which is about $\frac{3}{8}$ of a wavelength at a frequency in said range of frequencies.

4. The radiation structure recited in claim 1 wherein:

one end of said second slot extends into said first section of said conductor and has a substantially circular periphery; and said first section of said conductor has a substantially circular, larger, outer periphery whereby said first section of said conductor is substantially annular.

5. The radiation structure recited in claim 1 wherein:

said first and second slots together comprise an aperture in said wide, thin conductor; and said first section of said conductor connects said first transmission line member to said second transmission line member.

6. The radiation structure recited in claim 5 wherein said first elongated slot is disposed perpendicularly with respect to said second elongated slot.

7. The radiation structure recited in claim 6 wherein:

an end of said second elongated slot connects to the longitudinal center of said first elongated slot to provide a T-shaped aperture having a leg portion and a connected cross-bar portion and said second slot comprises said leg portion and said first slot comprises said cross-bar portion.

8. The radiation structure recited in claim 7 wherein:

said element is symmetrically disposed about a given line of symmetry and has first and second ends;

said first section extends to said first end of said element;

said third section extends to said second end of said element;

said T-shaped aperture is disposed symmetrically about said line of symmetry; and said leg portion has a foot portion which extends into said first section of said conductor to space apart the portions of said first section which connect to said first and second transmission line members.

9. A radiation structure for operation over a range of frequencies comprising:

a one piece radiating element in the form of a wide, thin electrical conductor, said conductor having first, second and third sections, said third section being wider than said first section and said second section connecting said first section to said third section;

said first section adapted for connection to a feed circuit;

said third section comprising a folded dipole having first and second feed points;

said third section having a first elongated slot to define the inner periphery of said folded dipole;

said conductor having a second elongated slot connected to and extending from said first slot through said second section to said first section to space apart said first and second feed points of said folded dipole and to separate said second section into first and second spaced apart transmission line members, said first and second transmission line members coupling said first section to said feed points of said folded dipole;

said conductor is symmetrically disposed about a given line of symmetry and has first and second ends;

said first section extends to said first end of said element;

said third section extends to said second end of said element;

said first elongated slot is disposed perpendicularly with respect to said second elongated slot;

said first and second slots together comprise an aperture in said wide, thin conductor;

said first section of said conductor connects said first transmission line member to said second transmission line member;

an end of said second elongated slot connects to the longitudinal center of said first elongated slot to provide a T-shaped aperture symmetrically disposed about said line of symmetry and having a leg portion and a connected cross-bar portion and said second slot comprises said leg portion and said first slot comprises said cross-bar portion;

said leg portion has a foot portion which extends into said first section of said conductor to space apart the portions of said first section which connect to said first and second transmission line members;

said element being free of ground conductors extending parallel to said second and third sections;

said first slot being less than $\frac{3}{8}$ of a wavelength long at a frequency within said range of frequencies;

said first section of said conductor has a substantially circular outer periphery and said foot portion of said aperture has a substantially circular, smaller, periphery whereby said first section of said conductor is substantially annular;

said third section of said conductor has a substantially rectangular outline; and said substantially rectangular portion and said substantially circular portion are spaced apart by said second section and said second section has a substantially trapezoidal outline.

10. The radiation structure recited in claim 9 wherein:

said element has a height dimension of substantially a quarter wavelength at a frequency in said operating range, said height extending from the point where said first and second sections meet to said second end of said element.

11. A radiation structure for operation over a range of frequencies comprising:

a one piece radiating element in the form of a wide, thin electrical conductor, said conductor having first, second and third sections, said third section being wider than said first section and said second section connecting said first section to said third section;

said first section adapted for connection to a feed circuit;

said third section comprising a folded dipole having first and second feed points;

said third section having a first elongated slot to define the inner periphery of said folded dipole;

said conductor having a second elongated slot connected to and extending from said first slot through said second section to said first section to space apart said first and second feed points of said folded dipole and to separate said second section into first and second spaced apart transmission line members, said first and second transmission line members coupling said first section to said feed points of said folded dipole; and each of said transmission line members tapering from said first section to said third section.

12. A radiation structure for operation over a range of frequencies comprising:

a one piece radiating element in the form of a wide, thin electrical conductor, said conductor having first, second and third planar sections, said third section being wider than said first section and said second section connecting said first section to said third section;

said first section adapted for connection to a feed circuit;

said third section comprising a folded dipole having first and second feed points;

said third section having a first elongated slot to define the inner periphery of said folded dipole;

said conductor having a second elongated slot in communication with and extending from said first slot through said second section to said first section to space apart said first and second feed points of said folded dipole and to separate said second section into first and second spaced apart transmission line members, said first and second transmission line members coupling said first section to said feed points of said folded dipole;

said second and third sections being disposed in a common plane;

said element being free of ground conductors extending parallel to said second and third sections;

said first slot being less than $\frac{3}{8}$ of a wavelength long at a frequency within said range of frequencies; and said first section is bent at about 90° to said common plane.

* * * * *